US009277800B2

(12) United States Patent
Gueret

(10) Patent No.: US 9,277,800 B2
(45) Date of Patent: Mar. 8, 2016

(54) APPLICATOR FOR APPLYING A COMPOSITION TO THE EYELASHES

(71) Applicant: L'OREAL, Paris (FR)

(72) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 154 days.

(21) Appl. No.: 13/954,353

(22) Filed: Jul. 30, 2013

(65) Prior Publication Data

US 2013/0315647 A1 Nov. 28, 2013

Related U.S. Application Data

(63) Continuation of application No. 13/702,504, filed as application No. PCT/IB2011/052716 on Jun. 21, 2011, now abandoned.

(60) Provisional application No. 61/365,027, filed on Jul. 16, 2010.

(51) Int. Cl.

| | |
|---|---|
| ***A46B 11/00*** | (2006.01) |
| ***A45D 40/26*** | (2006.01) |
| ***A46B 9/02*** | (2006.01) |

(52) U.S. Cl.

CPC ..... *A45D 40/267* (2013.01); *A45D 40/265* (2013.01); *A46B 9/021* (2013.01); *A46B 2200/1053* (2013.01)

(58) Field of Classification Search

CPC ..... A46B 2200/1053; A46B 2200/106; A46D 40/262

USPC ..... 401/126–129; 132/218

See application file for complete search history.

(56) References Cited

U.S. PATENT DOCUMENTS

| | | | | |
|---|---|---|---|---|
| 5,937,869 | A | 8/1999 | Lhuisset | |
| 7,581,546 | B2 * | 9/2009 | Dumler | 132/218 |

(Continued)

FOREIGN PATENT DOCUMENTS

| | | |
|---|---|---|
| DE | 196 42 720 A 1 | 4/1998 |
| WO | WO 96/32033 | 10/1996 |

(Continued)

OTHER PUBLICATIONS

Sep. 19, 2011 Written Opinion of the International Searching Authority issued in International Application No. PCT/IB2011/052716.

(Continued)

*Primary Examiner* — Jennifer C Chiang
(74) *Attorney, Agent, or Firm* — Oliff PLC

(57) ABSTRACT

An applicator for applying a cosmetic composition to the eyelashes or the eyebrows, the applicator including a molded applicator member including: a core that extends along a longitudinal axis; and teeth that extend from the core, the teeth being disposed in more than four longitudinal rows along the longitudinal axis (X) of the core; the teeth presenting free ends that define an envelope surface of the applicator member, the envelope surface presenting, at least at one point along its length, a cross-section of shape that is flat, having a greatest transverse dimension lying in the range 7 mm to 12 mm, and a thickness lying in the range 3.5 mm to 7 mm.

15 Claims, 8 Drawing Sheets

(56) References Cited

U.S. PATENT DOCUMENTS

| | | | | |
|---|---|---|---|---|
| 8,042,555 | B2 * | 10/2011 | Neuner et al. | 132/218 |
| 8,096,306 | B2 * | 1/2012 | Malvar et al. | 132/218 |
| 8,151,807 | B2 * | 4/2012 | Holloway et al. | 132/218 |
| 8,944,714 | B2 * | 2/2015 | Gueret | 401/129 |
| 2004/0035437 | A1 * | 2/2004 | Gueret | 132/218 |
| 2006/0070635 | A1 * | 4/2006 | Dumler et al. | 132/218 |
| 2011/0164914 | A1 * | 7/2011 | Caulier | 401/129 |

FOREIGN PATENT DOCUMENTS

| | | | |
|---|---|---|---|
| WO | WO 2009/053925 | A2 | 4/2009 |
| WO | WO 2009/153761 | A2 | 12/2009 |

OTHER PUBLICATIONS

Sep. 19, 2011 International Search Report issued in International Application No. PCT/IB2011/052716.

* cited by examiner

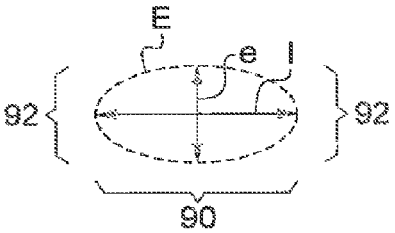
Fig.6a
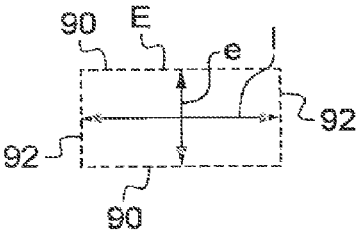
Fig.6b
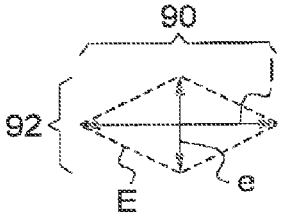
Fig.6c
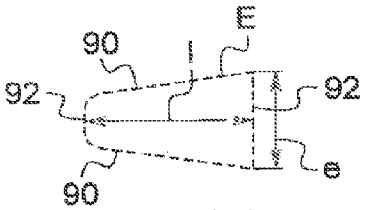
Fig.6d
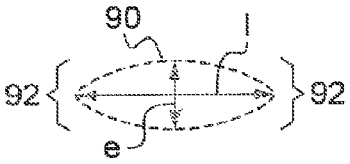
Fig.6e
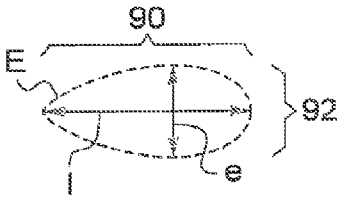
Fig.6f
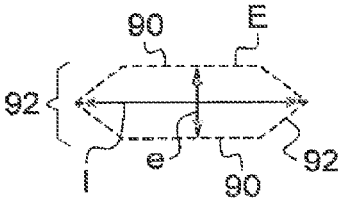
Fig.6g
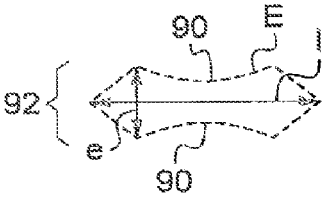
Fig.6h
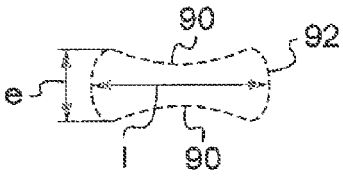
Fig.6i
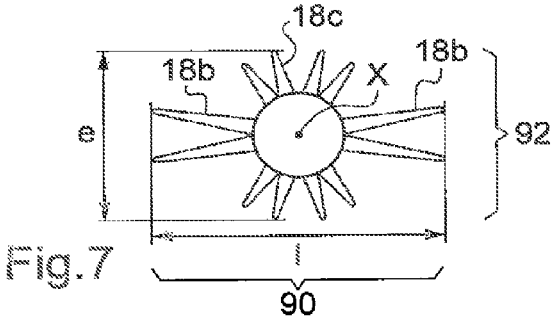
Fig.7
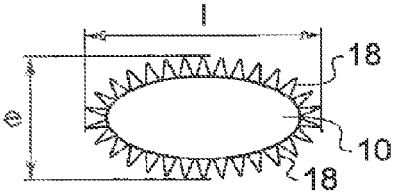
Fig.7a
Fig.8
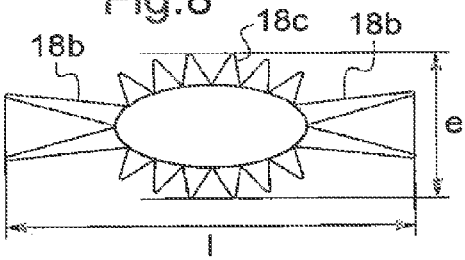
Fig.9
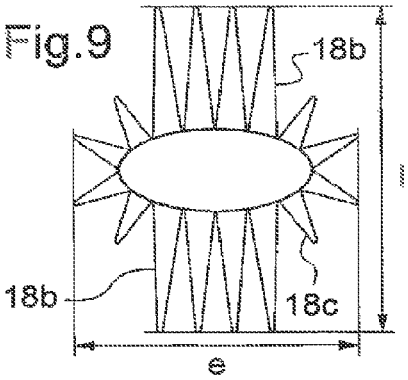

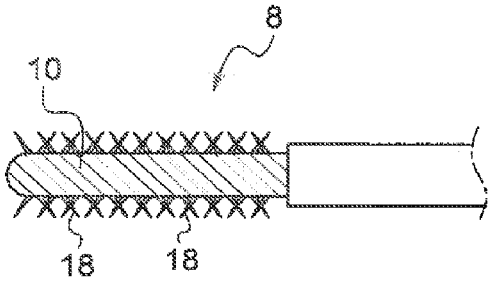
Fig.11
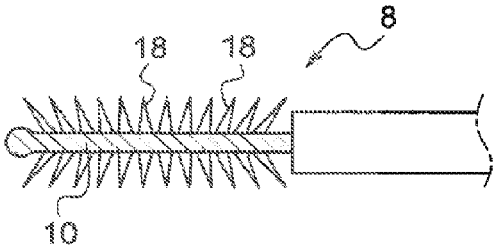
Fig.12
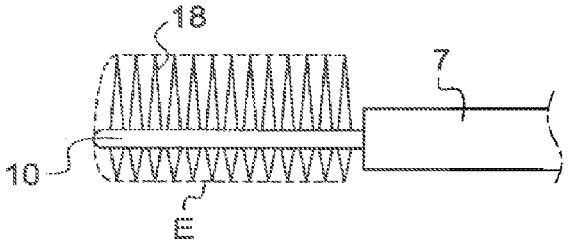
Fig.12a
Fig.13
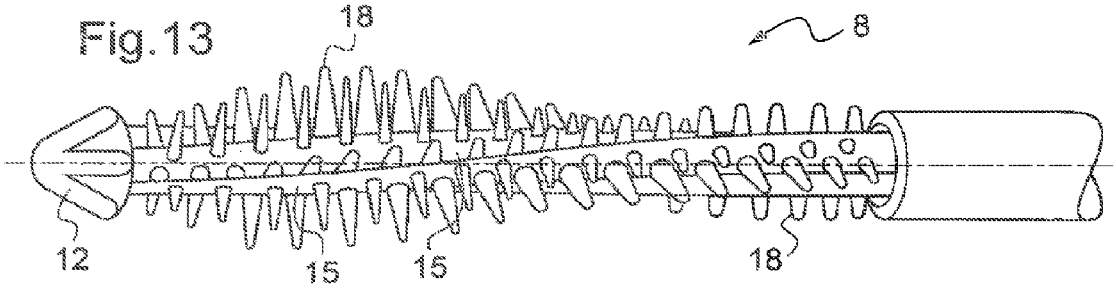
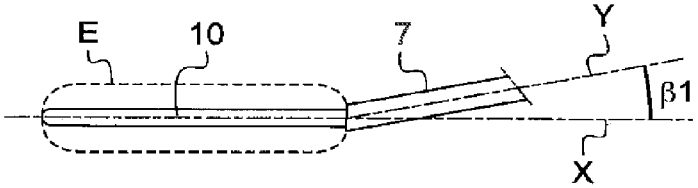
Fig.14

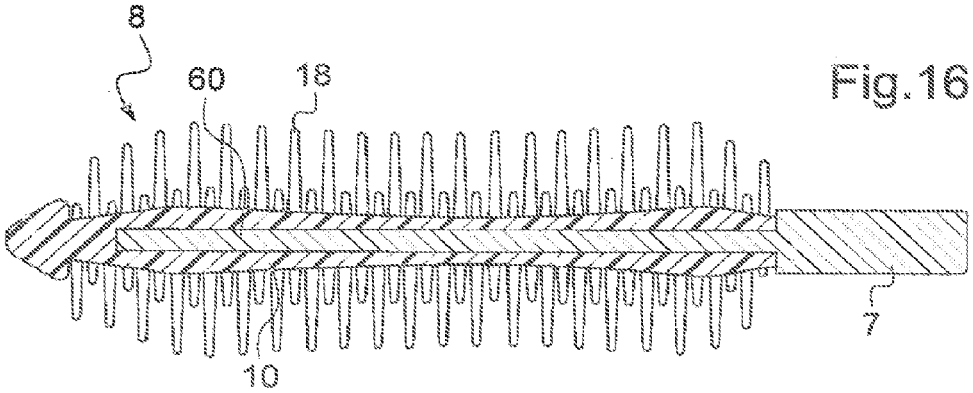
Fig.16
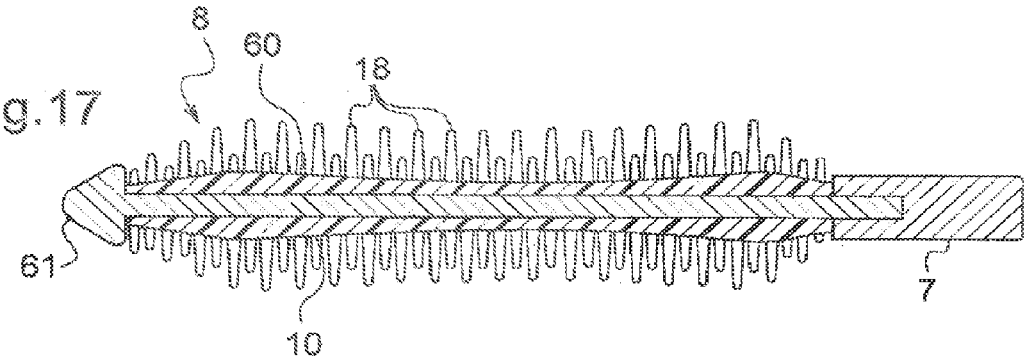
Fig.17
Fig.18a
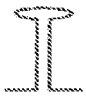
Fig.18b
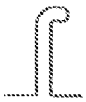
Fig.18c

APPLICATOR FOR APPLYING A COMPOSITION TO THE EYELASHES

This is a Continuation of application Ser. No. 13/702,504 filed Dec. 6, 2012, which in turn is a National Phase Application of PCT/IB2011/052716, filed on Jun. 21, 2011, which claims the benefit of U.S. Provisional Application No. 61/365,027 filed Jul. 16, 2010, and claims the benefit of French Application No. 1055320, filed on Jul. 1, 2010. The disclosure of the prior applications is hereby incorporated by reference herein in its entirety.

The present invention, relates to applicators for applying a cosmetic, makeup, or care-product composition to the eyelashes or the eyebrows, e.g. mascara.

More particularly, the invention, relates to applicators including a molded applicator member, with a core extending along a longitudinal axis and teeth that are carried by the core.

International application WO 2009/153761 relates to a mascara brush that presents bristles that are held in a twisted core, a greatest transverse dimension of the brush lying in the range 9 millimeters (mm) to 14 mm, and the brush being at least 30% wider than it is thick in cross section.

In international application WO 2009/053925, the applicator member includes rows of long teeth and rows of short teeth, the rows of long teeth and of short teeth differ by the spacing between the teeth, the number of teeth in a row, or the thickness of a tooth measured perpendicularly to its long direction.

There exists a need to enable the user to coat the eyelashes well and to separate them properly, while ensuring the makeup is applied in gentle and easy manner.

There also exists a need to benefit from an applicator that makes it possible to produce novel makeup effects on the eyelashes or the eyebrows that are optionally pre-coated with composition, to obtain good penetration of the applicator member in the eyelashes or the eyebrows, e.g. so as to comb them, coat them, extend them, and separate them better, and to do so while enabling, a satisfactory quantity of composition to be loaded onto the applicator, and requiting the use of hand movements that are easy to perform.

The invention seeks to satisfy all or some of those needs.

Exemplary embodiments of the invention provide an applicator for applying a cosmetic, makeup, or care-product composition to the eyelashes or the eyebrows, the applicator including a molded applicator member comprising:

a core extending along a longitudinal axis; and teeth that extend from the core, the teeth being disposed in more than four longitudinal rows along the longitudinal axis of the core;

the teeth presenting free ends that define an envelope surface of the applicator member, the envelope surface presenting, at least at one point along its length, better over at least half of its length, better still over all of its length, a cross-section of shape that is flat, having a greatest transverse dimension lying in the range 7 mm to 12 mm, better in the range 8 mm to 12 mm, or even in the range 9 mm to 12 mm, and a thickness lying in the range 3.5 mm to 7 mm, better in the range 4 mm to 6.5 mm.

The applicator of the invention makes it possible to deposit large quantities of composition on the eyelashes or the eyebrows, while ensuring that said eyelashes or eyebrows are combed and separated in satisfactory manner. Furthermore, the resulting makeup effect may be reproducible if necessary.

The teeth of all of the rows contained in a cross-section are preferably of the same thickness, and/or two successive teeth of two rows taken in a common segment of the envelope surface have spacing between them that is identical.

The term "longitudinal axis of the core" is used to designate the line that joins together the centers of gravity (barycenters) of the cross-sections of the core. The longitudinal axis may be a central axis, or even an axis of symmetry for the core, in particular when the core presents a cross-section that is circular or that has the general shape of a regular polygon. The longitudinal axis of the core may be rectilinear or curved, and may be contained in a plane that may be a plane of symmetry for some or even for all of the cross-sections of the core. Preferably, the longitudinal axis of the core is rectilinear.

The core need not be twisted and the rows may be rectilinear, parallel to the longitudinal axis of the core.

In the meaning of the invention, teeth form part of the same "row of teeth" if when the applicator member is observed along its longitudinal axis, the teeth have a common join plane and/or are superposed other than at their bases, being more than merely tangential to the axis of the rows at their bases. It is possible for the bases of the teeth of a single row to be touching or spaced apart. When the teeth are spaced apart, and when the applicator member is observed perpendicularly to the longitudinal axis, the axial spacing between two consecutive teeth of a single row is measured between the closest-together ends of the bases of said consecutive teeth, and may lie in the range 0.1 mm to 5 mm, for example.

In exemplary embodiments, the core may carry an even or uneven number of rows of teeth. The applicator may include at least five rows of teeth, better at least six rows. The applicator may include up to twenty rows in total, or less than twenty rows in total.

The teeth carried by the core may be disposed in at least three double rows of teeth, or at least four double rows, or even at least six double rows of teeth. The term "double row of teeth" means two rows that are close together and parallel.

The teeth may be distributed all around the core in regular manner in at least a given cross-section, better over a major fraction of the length of the core, better still over the entire length of the core.

The longitudinal rows of teeth may be disposed all around the core, around its longitudinal axis X. Teeth may extend from the core in each of the four quadrants, when the core is observed in cross-section. The applicator member need not have an angular space without teeth of at least 60° measured at the surface of the core. The rows may be distributed regularly around the longitudinal axis of the core.

The term "distributed regularly" means that the longitudinal rows of teeth or the groups of associated rows of teeth, otherwise known as double rows, are disposed around the longitudinal axis in regular manner, i.e. around the longitudinal axis of the core, the angular spacing between two successive rows or between two successive double rows is substantially constant. The angular spacing is measured at the surface of the core, i.e. between the longitudinal axis of the core and the connection points of the teeth constituting the corresponding row at the surface of the core.

The term "greatest transverse dimension of a cross-section of the envelope surface at a point" means the dimension l corresponding to the greatest distance between two diametrally-opposite points of a cross-section of the envelope surface taken at this point along the length of the envelope surface.

The term "thickness e" means the greatest thickness e of the envelope surface measured in a section plane that is perpendicular to the longitudinal axis of the core in a direction that is perpendicular to the greatest transverse dimension l. The thickness may vary within the cross-section.

The greatest transverse dimension of the envelope surface may be greater than its thickness by at least 3 mm, or even by at least 4 mm.

The cross-section in which the greatest transverse dimension is measured may be taken at a point along the length of the envelope surface that is situated at a distance from the proximal and/or distal ends that is greater than one fourth of the total visible length of the applicator member.

The ratio l/e of the greatest transverse dimension l to the thickness e of a cross-section of the envelope surface may lie in the range 1.3 mm to 4.5 mm, better in the range 1.5 mm to 3.5 mm, better still in the range 1.7 mm to 3.5 mm.

By way of example, the cross-section of the envelope surface of the applicator member is rectangular, oval, oblong, lozenge-shaped, trapezoidal, lens-shaped, or kidney-shaped.

The applicator member may present two opposite main faces, with the spacing between them defining the thickness of the envelope surface of the applicator member. The main faces may be parallel to each other. They may be plane, concave, or outwardly convex in cross-section and/or longitudinal-section. One may be concave and the other convex in longitudinal section. The applicator member may further present two opposite side faces, e.g. that are plane, concave, or outwardly convex in cross-section.

The applicator member may present an envelope surface of cross-section that decreases towards the proximal and distal ends of the applicator member. The envelope surface may be frustoconical in the vicinity of the proximal and distal ends.

The term "tooth" is used to designate an element that projects individually for coming into engagement with the eyelashes or the eyebrows, the term being synonymous with "bristle" in the context of the present invention.

The teeth of all of the rows contained in a common cross-section may all be identical or they may differ by their length, or differ only by their length.

The term "identical teeth" means that all of the teeth taken in a given cross-section of the envelope surface, whatever the row of which they form a part, are all identical, i.e. they have the same shape, thus a cross-section of the same shape and of the same dimension at their bases, and are made out of the same material.

Two teeth of two different rows forming part of a common cross-section may have the same shape. Two teeth of two different rows forming part of a common cross-section may have the same cross-section, i.e. that are of the same shape and of the same dimensions. Two teeth of two different rows forming part of a common cross-section may be molded out of the same material.

Two consecutive teeth of two rows, better of all of the rows, taken in a common segment of the envelope surface, may have an axial spacing between them that is identical. The spacing between two consecutive teeth is measured at the bases of the teeth, at the surface of the core, between the closest ends of the bases of the consecutive teeth.

Around the longitudinal axis X of the core, two consecutive rows of teeth may be identical, better three consecutive rows, better still four consecutive rows. All of the longitudinal rows distributed around the longitudinal axis X of the core are preferably identical. The term "identical rows" means that two teeth of two rows forming part of a common cross-section are identical, that the axial spacing between two consecutive teeth of two rows taken in a common segment of the envelope surface is identical, and that the number of teeth in the rows is the same.

The rows of teeth may differ only by the lengths of the teeth from one row to another for a common axial position along the longitudinal axis of the core.

The applicator may include, in a common cross-section, long teeth and short teeth. The difference between the length of the long teeth and the length of the short teeth may be greater than 0.2 mm. The flat shape of the envelope surface preferably results from the presence of the long teeth and of the short teeth, distributed around the core in appropriate manner, e.g. in cross-section several groups of long teeth on either side of the core, with several groups of short teeth between the groups of long teeth. The groups of long teeth and of short teeth may also be separated by teeth of intermediate length.

The applicator may include 1 to 4 rows of long teeth on a main face of the core, and 1 to 6 rows of short teeth on another main face of the core. The rows of long teeth and of short teeth may be separated by rows of teeth of intermediate length, e.g. 1 to 4 rows of teeth of intermediate length.

The length of at least one tooth of the applicator, measured from the core, may lie in the range 2 mm to 8 mm, or even in the range 2 mm to 5 mm. The term "length of a tooth" is used to designate the distance measured along the long axis of the tooth between the free end of the tooth and its base via which it is connected to the core. The term "long axis of the tooth" is used to designate an axis that passes via the centers of gravity of the cross-sections of the tooth.

At least one tooth may extend from the core along a long axis of the tooth that is perpendicular to the surface of the core at the point where the tooth connects to the core. In a variant, the long, axis may form an angle that is different from 90° relative to the surface of the core, at the point where the tooth connects to the core. All of the long directions of the teeth may diverge when the applicator member is observed along the longitudinal axis of the core.

At least two rows of teeth that are consecutive around the longitudinal axis of the core may have respective longest teeth of lengths that are identical or different.

At least 50% of the teeth, e.g. of at least one row of the applicator member, e.g. at least 75%, e.g. substantially all of the teeth, may extend from the core in substantially radial manner.

In exemplary embodiments of the invention, the applicator member is molded within a mold that is formed by assembling together a plurality of shells. By way of example, the applicator member may be molded by assembling together six, eight, ten, or twelve shells, the number of shells possibly being selected as a function of the number of rows to be made.

The longest teeth of the applicator member may be of length lying in the range 1 mm to 8 mm, or even in the range 2 mm to 6 mm, e.g. in the range 1.5 mm to 4.5 mm.

The length of the teeth of at least one row may vary within a row, e.g. in monotonic manner, along the longitudinal axis of the row. For example, along the longitudinal axis of the core, the length of the teeth within at least one row may increase between the proximal end and a first abscissa, then remain substantially constant between the first abscissa and a second abscissa, then decrease between the second abscissa and the distal end. The length of the teeth within at least one row may have two maximums.

From one row to another in a common cross-section of the applicator member, the teeth need not differ by their shape, thickness, length, orientation, color, and/or material. Within a single row, the teeth may differ by at least one of their thickness, length, hardness, orientation, spacing, with the adjacent teeth of the row, color, and/or shape.

Some of the teeth, or even all of the teeth, may have a cross-section of shape that is semi-circular or semi-elliptical. A shape with a flat, such as a semi-circular or semi-elliptical shape, makes it easier to unmold the applicator member, the flat coinciding with the join plane of the mold.

At least one tooth may present a cross-section that is: circular, with or without a flat; non-circular; flat; star-shaped, e.g. cross-shaped with a plurality of branches; U-shaped; H-shaped; T-shaped; V-shaped; a hollow shape, e.g. circular or square; formed with ramifications, e.g. snowflake-shaped; a prismatic shape, e.g. triangular, square, or hexagonal; an oblong shape, in particular lens-shaped or hourglass-shaped; polygonal, optionally regular, in particular square, rectangular, octagonal, parallelogram-shaped, lozenge-shaped; or oval. At least one tooth may present at least one portion in relief, so as to improve the adherence of composition to the tooth. Without changing in shape, the cross-section of the tooth may decrease on moving away from the core, e.g. over more than half of the length of the tooth.

Some of the teeth of the applicator, or even all of the teeth, may have thickness, measured at their bases, i.e. at the point where a tooth connects to the core, lying in the range 0.2 mm to 1.5 mm, or even in the range 0.25 mm to 1 mm. The term "thickness of a tooth" is used to designate the greatest transverse dimension of the tooth, in section that is perpendicular to the long axis of the tooth. Each tooth may have a base of thickness that is less than the thickness of another portion of the tooth.

The thickness of the teeth may be selected as a function of the type of makeup effect desired and/or the nature of the eyelashes and/or the rheology of the composition, for example.

The teeth may be of any shape. The teeth may be of shape that is cylindrical or tapering, in particular frustoconical or pyramid-Shaped. At least one tooth may have a profile that is frustoconical, at least in part, e.g. terminated by a rounded free end, such that the cross-section of the tooth decreases towards its free end.

The applicator may include 75 to 600 teeth. Within a row of teeth, the number of teeth may be in the range 6 to 60, in particular in the range 10 to 50.

At least two teeth of at least one row may present lengths that are different or identical. A row of teeth extending along the longitudinal axis may have at least three teeth of the same length.

When the applicator is observed from the side, perpendicularly to its longitudinal axis, at least two teeth may define a V-shaped groove.

At least two consecutive teeth of a row of teeth may have first longitudinal faces both having a common first shape, e.g. plane, in particular at least at a bottom portion of the tooth, and second longitudinal faces both having, a common second shape, e.g. not plane, in particular rounded. The first faces may all face in the same direction around the core, i.e. they may all face in the same clockwise or counter-clockwise direction, when the core is observed along its longitudinal axis.

The first faces of the teeth, in particular when they are plane, may be connected substantially perpendicularly to the corresponding face of the core, at least for some teeth in the row.

At least one tooth, or even each tooth, may present a plane face that is parallel to its long direction.

The teeth may optionally be rectilinear, e.g. each extending along a long direction for the tooth that is rectilinear, or else they may be curved, e.g. undulating.

Since the longitudinal axis of a row is considered at the surface of the core, two longitudinal axes of two consecutive rows, around the longitudinal axis of the core, are preferably separated angularly by an angle that is less than 80°, e.g. about 60°, or even less than 50°, e.g. about 45°, e.g. about 30°, the angle being measured around the longitudinal axis of the core. Preferably, the axes of the rows are parallel to the longitudinal axis of the core.

When the core is observed along its longitudinal axis, it is possible to pass from one row to another or from one group of double rows to another by turning the core about its longitudinal axis through an integer sub-multiple of 360°, e.g. turning through 360°/n, where n is an integer that is greater than 4 and that is less than or equal to 20.

The teeth may extend in at least five different directions around the longitudinal axis of the core.

At least one tooth of a row may extend, at least at its portion that is connected to the core, or even over its entire length, along a first direction $Z_1$, perpendicular to the longitudinal face of the core to which the tooth is connected, or forming a small angle with the normal to said surface of the core, e.g. less than 10°, better 5°. A tooth of a consecutive row may extend from the same face of the core along a second direction $Z_2$, at least at the portion that is connected to the core, or even over its entire length, forming a non-zero angle $\alpha$ with the first direction, when the core is observed along its longitudinal axis.

Substantially half of the teeth of a row may extend parallel to the first direction $Z_1$. The angle $\alpha$ between the directions $Z_1$ and $Z_2$ may lie in the range 5° to 80°.

At least one tooth may extend along a longitudinal axis firming a non-zero angle with the normal to the longitudinal axis of the core when the applicator member is observed perpendicularly to the longitudinal axis of the core. Two teeth may thus extend along angles having values that are different, or even opposite, and may cross each other when the applicator member is observed in a direction that is perpendicular to its longitudinal axis. All of the teeth of two adjacent rows may cross one another.

The length of a row preferably lies in the range about 10 mm to 45 mm, in particular in the range 15 mm to 35 mm, or even in the range 20 mm to 30 mm, e.g. being about 27 mm.

The core may present, in cross-section, a greatest transverse dimension lying in the range 1.5 mm to 6 mm, or even in the range 1.5 mm to 4 mm.

The core may have 3 to 20 longitudinal faces, better 5 to 8 longitudinal faces. The faces of the core ma be plane or slightly concave or slightly convex.

The core may present at least one cross-section of circular or regular polygonal shape, e.g. in the shape of an optionally-regular polygon, e.g. triangular, square, pentagonal, hexagonal, heptagonal, or octagonal. In this configuration, the flat shape of the envelope surface may be obtained merely by the choice of the length of the teeth and the distribution of the long teeth and of the short teeth around the core.

In a variant, the core may present a cross-section of shape that is oblong, e.g. elliptical, oval, rectangular, lozenge-shaped, trapezoidal, lens-shaped, or kidney-shaped. In this configuration, the flat shape of the envelope surface may be obtained merely by the choice of the shape of the core in cross-section, the teeth of a cross-section distributed around the core thus possibly all having the same length, for example.

Still in a variant, the flat shape of the envelope surface may be obtained both by the flat shape of the cross-section of the core, and by the choice of the length of the teeth and the distribution of the long teeth and of the short teeth around the core.

The core may include a cross-section, perpendicular to its longitudinal axis, of shape that varies along the longitudinal axis of the core. By way of example, the core may have a cross-section of shape that is optionally constant along the longitudinal axis of the core, e.g. over at least half, or three-fourths, or even all of the length of a portion of the core carrying the teeth. By way of example, the cross-section of the core may vary in geometrically-similar manner. From the proximal end to the distal end of the applicator member, the cross-section of the core may increase or decrease in monotonic manner, for example. From the proximal end to the distal end of the applicator member, the cross-section of the core nay present an extremum, e.g. an absolute minimum or maximum.

When observed perpendicularly to its longitudinal axis, the core may present a profile that varies. In particular, the core may present a transverse dimension that reaches an extremum substantially mid-way along its length. This may impart increased flexibility or rigidity to the core, and makes it possible to define an envelope surface of section that varies along the applicator member, in particular when the teeth in a row are of the same length, at least over a fraction of the applicator member.

The core may present a single-strand longitudinal section of shape selected from the following list: a shape having thickness that is optionally constant, in particular rectangular; rugby-ball shaped; peanut shaped; bullet shaped; conical shaped; frustoconical shaped; fish shaped. They need not have open-work cavities.

In at least one cross-section plane, the core may have an axis of symmetry that is its longitudinal axis, for example.

The core and the teeth may be molded out of a single material, or, in a variant, they may be made out of at least two different materials. By way of example, a portion of the core and of the teeth may be made out of a first material, and another portion of the core and of the teeth may be made out of a second material, e.g. that is more flexible or harder than the first. By way of example, the core is formed of one or more thermoplastic materials that may be elastomeric. The core and/or the teeth may be made out of an elastomer material, a thermoplastic material, a thermosettable material, out of metal, or out of ceramic. In exemplary embodiments of the invention, the teeth are made with the core by molding or by overmolding. By way of example, the teeth may be made by "protrusion", in which technique material is injected through at least a portion of the core, so as to enable teeth to be formed.

The core may include a tubular body carrying the teeth, which body is fitted on a hub for mounting on the stem or forming part of said stem. The hub may be made of metal or of plastics material. The tubular body may be configured to be fastened to the hub, or it may be free to turn or to move in translation relative to the hub.

In a variant, the portion of the core that supports the teeth is solid.

The applicator may include a stem having a first end carrying the applicator member, and a second end fastened to a handle by fastener means including keying means. The handle may include a marker for indicating the orientation of the applicator member relative to the handle. By way of example, the marker may comprise an alphanumeric sign, a logo, a color, or it may even result from an asymmetric shape of the handle. The marked orientation of the applicator member relative to the handle makes the applicator easier to use, enabling the eyelashes to be brought into contact with teeth, either of one of the main faces, or of one of the side faces.

The stem may include a distal portion that is elastically deformable. By way of example, the distal portion is formed by an endpiece that is fitted on the remainder of the stem that may be made of a material that is more rigid. The endpiece may include one or more annular grooves, thereby imparting more flexibility thereto.

The applicator member may be connected to the stem, e.g. by snap-fastening, adhesive, heat sealing, crimping, stamping, force-fitting, cold or hot, e.g. by mounting in a housing of the stem. In a variant, the stem may be received in a housing provided in the core. The stem and the applicator member may also be molded as a single part, optionally out of the same thermoplastic material.

The teeth may be made of a material that is more rigid or less rigid than a material that is used to make the stem of the applicator to which the core is connected.

The applicator member may include a mounting endpiece that is molded integrally with the core, and that may where appropriate, include one or more constricted portions making it possible to improve the flexibility of the applicator and flexibility in application.

A greatest transverse dimension of the core may be less than, greater than, or equal to a greatest transverse dimension of the stem.

The visible length of the applicator member, i.e. the length of the applicator member protruding from the stem and measured along the longitudinal axis of the core may lie in the range 20 mm to 35 mm, for example.

The core may extend along a longitudinal axis that, at least at one point along its length, forms an angle with the longitudinal axis of the stem to which the core is fastened. The applicator member may be bent where it connects to the stem.

Where appropriate, the envelope surface may extend along a longitudinal axis that forms a non-zero angle with the longitudinal axis of the core. The longitudinal axis of the envelope surface may optionally be rectilinear.

The envelope surface may be of greatest transverse dimension that is substantially constant over at least a fraction of the length of the applicator member, in particular over more than half of the length of the portion of the core carrying teeth.

The envelope surface may also present a cross-section that varies over all or part of the length of the applicator member. By way of example, the applicator member may have one or more extremums, e.g. at least one local minimum and two local maximums. By way of example, the envelope surface may be peanut-shaped when the applicator member is observed from the side, in a direction that is perpendicular to its longitudinal axis.

The envelope surface of the applicator member may be twisted, i.e. it may present an angular offset between its distal and proximal ends that may be relatively small. The term "angular offset" means the angle through which the long axis of the cross-section turns between said ends. The angular offset between the distal end and the proximal end of the corkscrewed portion may lie in the range 20° to 80°, better it may be less than 35°, better still it may lie in the range 25° to 35°, or it may even be equal to about 30°.

The corkscrew configuration of the applicator member may be obtained by the shape of the mold used for molding, or, in a variant, the core may be deformed while unmolding, by exerting torsion on said core, in particular while the material is still hot.

The angular offset may be measured between the long directions of the end teeth of a helical row.

The invention also provides a packaging and applicator device comprising:

a container containing a composition for application to the eyelashes and/or the eyebrows; and an applicator as defined above.

The device may include a wiper member for wiping the applicator member while it is being taken out of the container, said wiper member being disposed on a neck of the container, for example. The wiper member may be of any suitable type, being flexible or rigid, and having one or two stages.

Because of its flat cross-section the applicator member is capable of passing through the wiper member without its teeth being compressed excessively over any of its periphery, and the applicator member may present relatively little resistance on passing through the wiper member.

The applicator member makes it possible to obtain wiping that is not uniform, leading to zones that are loaded unequally with composition.

The longest teeth of the applicator member may be wiped thoroughly. The shortest teeth may be more loaded relative thereto.

Thus, the user may have a greater quantity of composition available on the applicator member, making it possible to add composition locally to the eyelashes if that turns out to be necessary while making up, without any need to put the applicator member back into the container. In addition, the user has teeth available that are loaded with less composition, advantageously being suitable for separating the eyelashes, in particular the small eyelashes at the ends of the eyelid.

In addition, the piston phenomenon associated with the suction created by extracting the stem may be of limited effect because of the intake of air made possible by the shape of the applicator member.

The wiper member may include a wiper orifice presenting a greatest transverse dimension lying in the range 2.5 mm to 6.5 mm, better in the range 2.5 mm to 5 mm. The wiper orifice may present a greatest transverse dimension that may go up to 6.5 mm, in particular when the core has a greatest transverse dimension that is greater than the length of the teeth.

The wiper member may include a wiper orifice that presents a greatest transverse dimension that is less than a greatest transverse dimension l of the applicator member.

The device may be configured so that the applicator member is set back by a distance that is less than 1.5 mm, or less than 1 mm, better less than 0.5 mm from the inside surface of the container when the applicator is in place on the container in a storage position.

The handle of the applicator may be used as a closure cap for closing the container. The container and the closure cap may be configured in such a manner as to close the container in leaktight manner. The handle and the container may cooperate with each other by screw-fastening, for example.

Preferably, the composition is a mascara, e.g. a water-resistant mascara.

Other exemplary embodiments of the invention also provide a method of applying makeup to the eyelashes or the eyebrows, said method comprising the step consisting in applying a composition to the eyelashes or the eyebrows by means of an applicator as defined above.

An orientation of the applicator relative to the eyelashes or the eyebrows may be selected in such a manner as to bring the eyelashes or the eyebrows into contact with a large main face of the envelope surface of the applicator member, or, on the contrary, with a small side face, in view of its flat cross-section.

The invention can be better understood on reading the following detailed description of non-limiting embodiments thereof, and on examining the accompanying drawings, in which.

Figure 5:
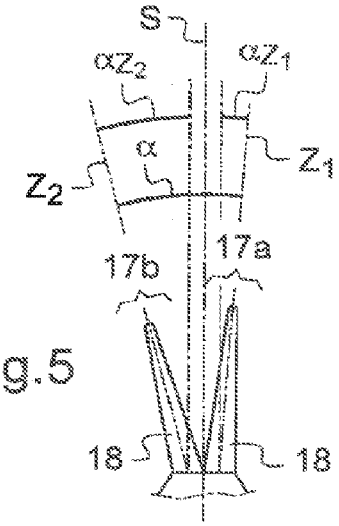
FIG. 5 shows a detail of FIG. 4.
Figure 5A:
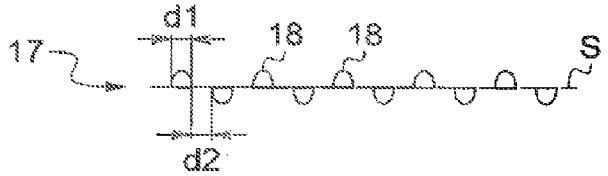
Figure 5B:
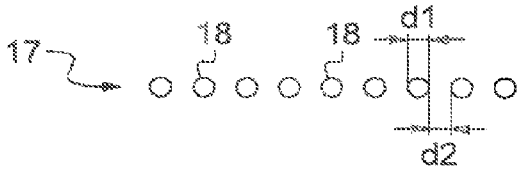
Figure 10N:
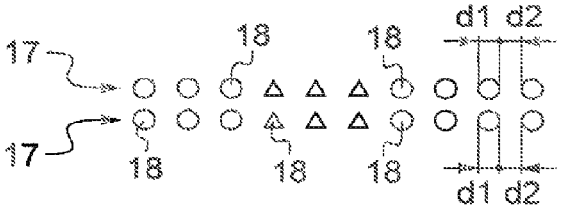
Figure 19A:
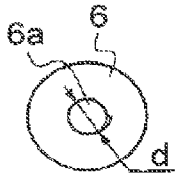
Figure 19B:
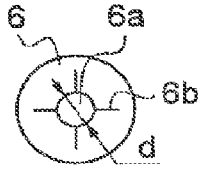
Figure 19C:
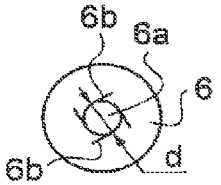
Figure 19D:
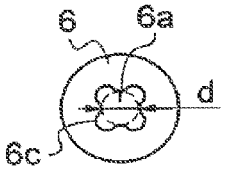
Figure 19F:
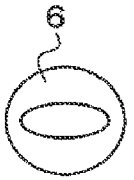
Figure 19E:
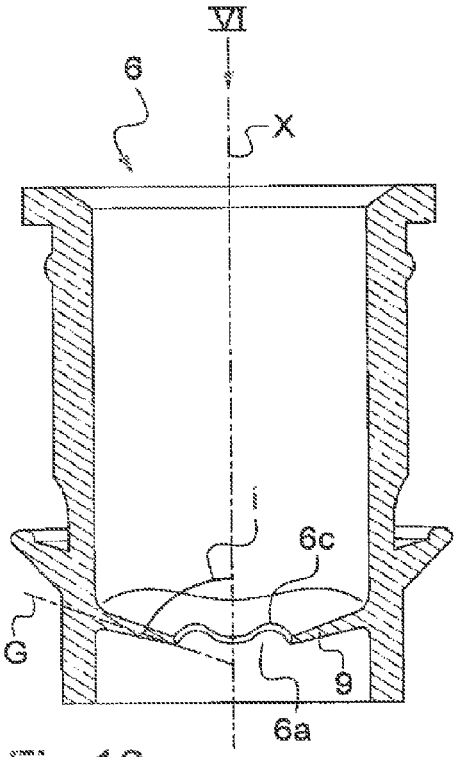
Figure 20A:
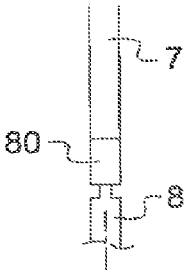
Figure 20B:
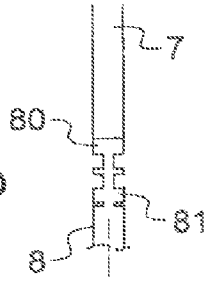
Figure 20C:
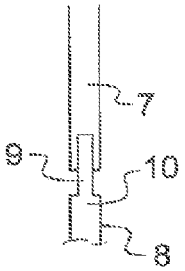
Figure 21:
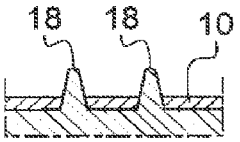

FIG. 5*a* is a diagrammatic and fragmentary plan view of a row of teeth;

FIG. 5*b* is a diagrammatic and fragmentary plan view of a row of teeth;

FIGS. 6*a* to 6*i* are diagrammatic and fragmentary cross-sections showing shapes of envelope surfaces;

FIGS. 7, 7*a*, 8, and 9 are diagrammatic and fragmentary cross-sections of variant embodiments;

FIGS. 11, 12, and 12*a* are diagrammatic longitudinal sections showing variant embodiments of the applicator member;

FIGS. 10*a* to 10*m* to show various shapes of core section;

FIG. 10*n* is a diagrammatic and fragmentary plan view of two rows of teeth;

FIGS. 13 and 14 are diagrammatic side views showing variant applicator members of the invention;

FIGS. 15*a* to 15*j* are diagrammatic longitudinal sections showing variant envelope-surface shapes;

FIGS. 16 and 17 are longitudinal sections of variant applicator members of the invention;

FIGS. 18*a* to 18*c* are diagrams of examples of teeth of the invention;

FIGS. 19*a* to 19*d*, and 19*f* show variant embodiments of wiper members;

FIG. 19*e* is a longitudinal section of the FIG. 19*d* wiper member;

FIGS. 20*a* to 20*c* show three variant embodiments of the distal end of the stem, and FIG. 21 is a diagrammatic and fragmentary longitudinal section of a variant embodiment.

Figure 1:
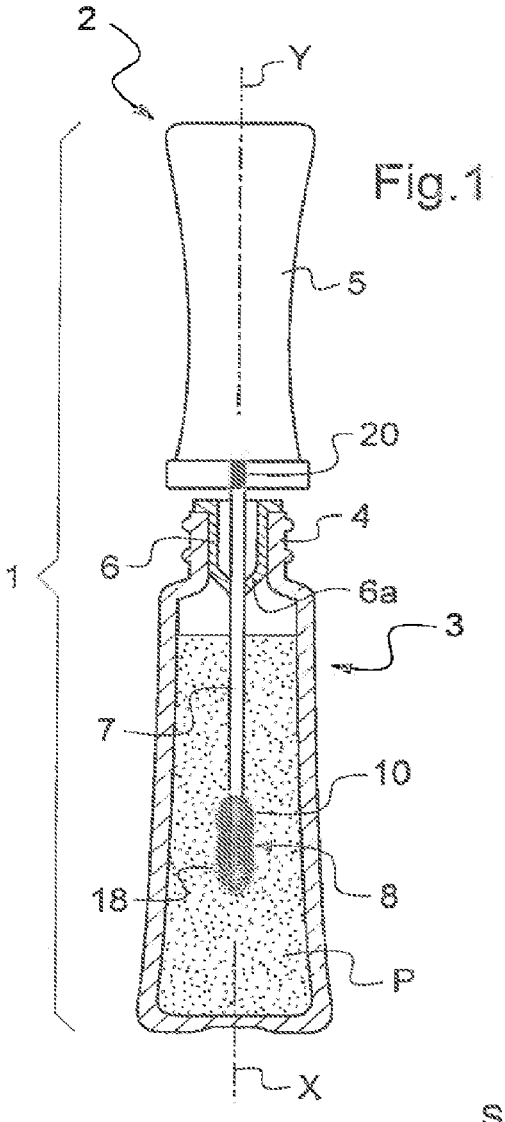
FIG. 1 is a diagrammatic elevation view, partially in longitudinal section, showing an example of a packaging and applicator device made in accordance with the invention.

FIG. 1 shows a packaging and applicator device 1 made in accordance with the invention, the device comprising an applicator 2 and an associated container 3 containing a composition P for application to the eyelashes and/or the eyebrows, e.g. mascara or a care product.

In the embodiment under consideration, the receptacle 3 includes a threaded neck 4, and the applicator 2 includes a closure cap 5 that is arranged to be fastened on the neck 4 so as to close the receptacle 3 in leaktight manner when not in use, the closure cap 5 also constituting a handle for the applicator 2.

The applicator 2 includes a stem 7 of longitudinal axis Y, which stem is connected at its top end to the closure cap 5, and at its bottom end to an applicator member 8. The applicator member comprises a core 10 carrying teeth 18.

The container 3 also includes a wiper member 6 that is inserted in the neck 4, for example.

In the embodiment under consideration, the wiper member 6, which may be of any type, includes a lip that is arranged to wipe the stem 7 and the applicator member 8 while the applicator 2 is being removed from the container 3. The lip defines a wiper orifice 6*a* of diameter that is adapted to the diameter of the stem.

In the embodiment shown, the stem 7 presents a cross-section that is circular, but it would not be beyond the ambit of the present invention for the stem 7 to present some other section, the cap 5 thus possibly being fastened on the container 3 other than by screw-fastening, if necessary. The wiper member is adapted to the shape of the stem 7 and to the shape of the applicator member 8, where appropriate.

Preferably, and as in the embodiment under consideration, the longitudinal axis Y of the stem 7 is rectilinear and coincides with the longitudinal axis of the container 3 when the applicator 2 is in place thereon, but it would not be beyond the ambit of the present invention for the stem 7 to be non-rectilinear, e.g. forming a bend.

Where appropriate, the stem 7 may include an annular narrowing at its portion that comes to be positioned facing the lip of the wiper member 6, so that said wiper member is not mechanically stressed unduly during storage.

The applicator member 8 may be fastened on the stem 7 by any means, and in particular by force-fitting, by snap-fastening by adhesive, by heat-sealing, or by crimping in a corresponding housing provided at the end of the stem 7.

Figure 2:
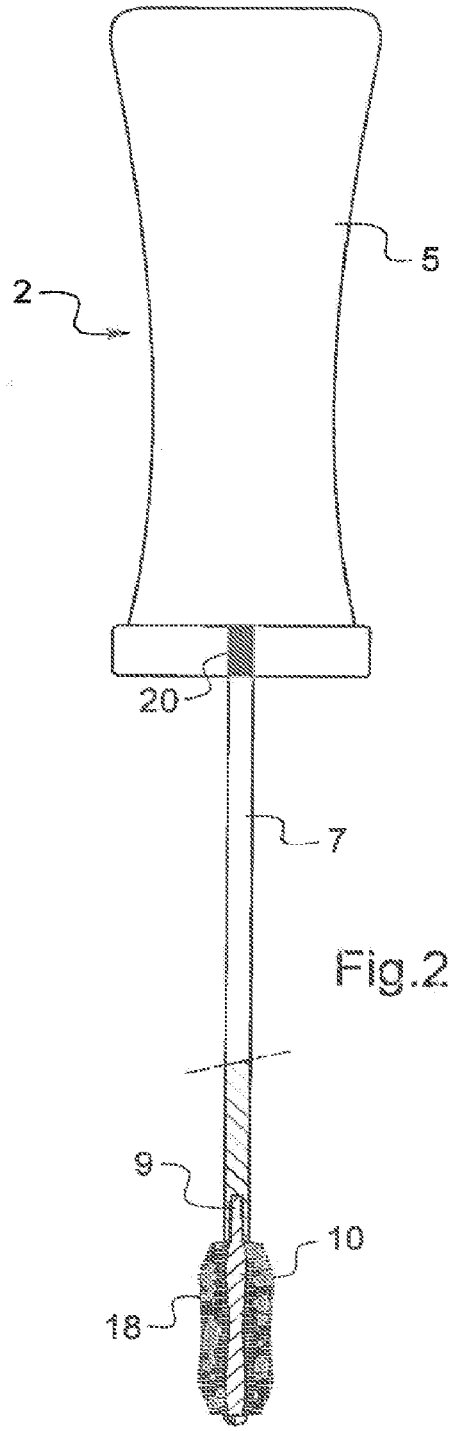
FIG. 2 is partially in longitudinal section, and shows the FIG. 1 applicator in isolation.

As shown in FIG. 2, the applicator member 8 may include an endpiece 9 enabling it to be fastened in a corresponding housing of the stem 7, possibly in a specific orientation.

In a variant, the stem 7 may be inserted into a housing provided in the core. The core 10 may also be molded integrally with the stem 7.

Figure 3:
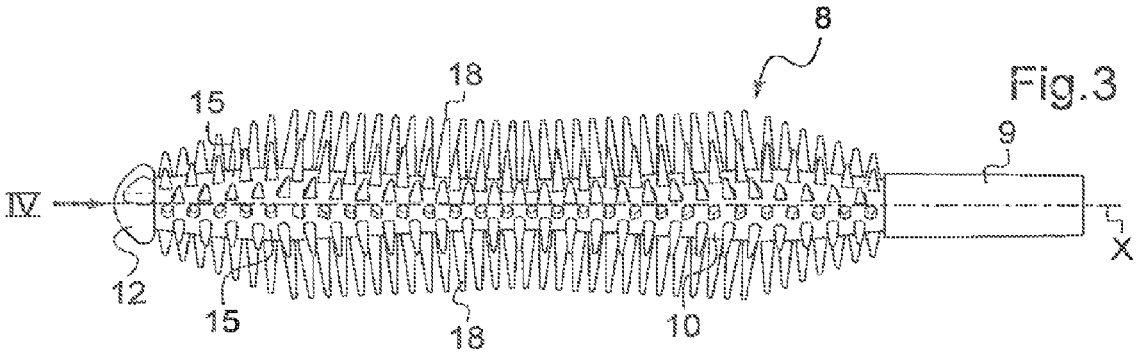
FIG. 3 shows the FIG. 1 applicator member of the device in isolation.

With reference to FIG. 3, it can be seen that the core 10 is of elongate shape along a longitudinal axis X that may be rectilinear or curved.

In the embodiment under consideration, over the majority of its length, the core 10 may present a cross-section that is polygonal, preferably in the shape of a regular polygon, having sides that define longitudinal faces 15 carrying teeth 18. The width of each face 15 may vary along the longitudinal axis of the core X, as shown in FIG. 3. The longitudinal axis X may be central, as shown.

In the embodiment under consideration, the teeth 18 are made integrally with the core 10 by molding thermoplastic material.

In order to mold the applicator member 8, it is possible to use any thermoplastic material that is optionally relatively rigid, e.g.: styrene-ethylene-butylene-styrene (SEBS); a silicone rubber; latex rubber; a material having good slip; butyl rubber; ethylene-propylene terpolymer rubber (EPDM); a nitrile rubber; a thermoplastic elastomer; a polyester, polyamide polyethylene, or vinyl elastomer; a polyolefin such as polyethylene (PE) or polypropylene (PP); polyvinyl chloride (PVC); ethyl vinyl acetate (EVA); polystyrene (PS); SEBS; styrene-isoprene-styrene (SIS); polyethylene terephthalate (PET); polyoxymethylene (POM): polyurethane (PU); styrene acrylonitrile (SAN); polyamide (PA); or polymethyl methacrylate (PMMA). It is also possible to use a ceramic, e.g. an alumina-based ceramic, a resin, e.g. a urea formaldehyde type resin, possibly a material filled with graphite. In particular, it is possible to use materials known under the trade names Teflon, Hytrel®, Cariflex®, Alixin®, Santoprene®, Pebax®, Pollobas®, this list not being limiting.

Where appropriate, the teeth and the core may be made out of different materials, the teeth being molded through openings in the core, for example.

The teeth may be made out of a material that is softer than the material of the core, or, in a variant, that is harder than the material of the core.

Figure 4:
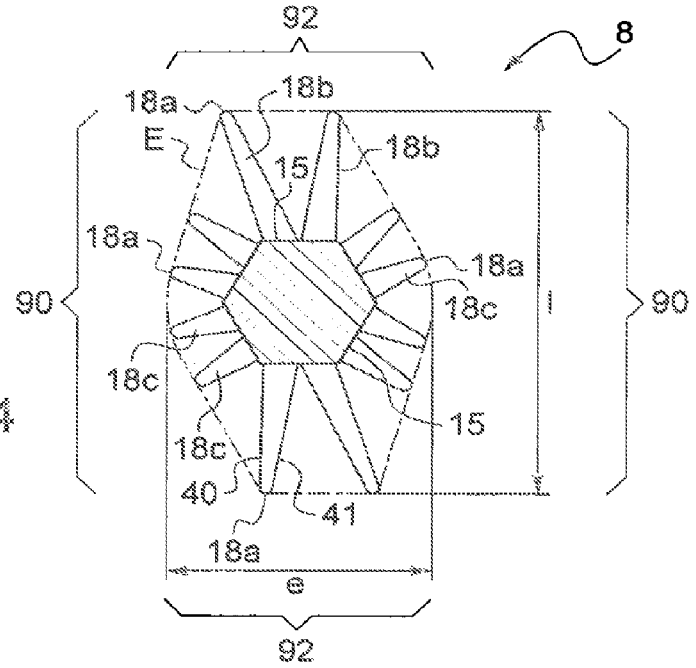
FIG. 4 is a view as seen looking along arrow IV in FIG. 3.

The teeth 18 are disposed in longitudinal rows 17 that are distributed regularly around the longitudinal axis of the core, as can be seen in FIG. 4.

The free ends 18*a* of the teeth define an envelope surface E, as can be seen in FIG. 4. The envelope surface E presents a flat cross-section having a greatest transverse dimension l lying in the range 8 mm to 12 mm, or even in the range 9 mm to 12 mm, and a greatest thickness e, measured perpendicularly to the greatest transverse dimension l in the same cross-section, lying in the range 3.5 mm to 7 mm, or even in the range 4 mm to 6.5 mm. Naturally, the thickness may vary in a common section. The thickness e is the greatest thickness measured perpendicularly to the greatest transverse dimension l.

For example:

TABLE 1

| | | | | | | | | |
|---|---|---|---|---|---|---|---|---|
| Wiper orifice diameter d (mm) | 3 | 4.2 | 4.15 | 4 | 3 | 5.5 | 3.5 | 5.5 |
| Greatest transverse dimension l (mm) | 9 | 9 | 9 | 10 | 11 | 12 | 9 | 9 |
| Thickness e (mm) | 4.5 | 6 | 5 | 2.5 | 2.5 | 5.5 | 3.5 | 3.5 |
| Ratio l/e | 2 | 1.5 | 1.8 | 4 | 4.4 | 2.2 | 2.6 | 2.6 |

In preferred exemplary embodiments, e=5 mm, l=9 mm or 10 mm, d=4.15 mm.

The values given in the above table are not limiting. These dimensions make the applicator perform particularly well, enabling the applicator to have a large area of contact with the eyelash during combing.

In the embodiment shown in FIGS. 1 to 4, the flat shape of the cross-section of the envelope surface is obtained by the presence of long teeth 18*b* and short teeth 18*c*, with long teeth 18*b* being disposed on either side of the core in two diametrally-opposite groups, and with short teeth 18*c* also being disposed on either side of the core in two diametrally-opposite groups, disposed between the two groups of long teeth 18*b*.

The ends 18*a* of the short teeth 18*c* thus define main faces 90 of the envelope surface, while the free ends 18*a* of the long teeth 18*b* define side faces 92 of the envelope surface.

In addition, all of the teeth 18*b* and 18*c* in a common cross-section may be identical, except for their lengths that are different. More precisely, they preferably have a common shape, a common cross-section of the same shape and of the same size, and be made of a common material. In other words, the thickness $d_1$ of the teeth may be the same, as can be seen in FIGS. 5*a* and 10*n*. Furthermore, two consecutive teeth of a row are preferably spaced apart by a spacing $d_2$ that is identical to two consecutive teeth of another row that is situated in a common segment of the envelope surface along the longitudinal axis X of the core.

As shown, the handle preferably includes a marker 20 for informing about the orientation of the applicator member relative to the handle, which marker enables the user to identify the position of the main faces 90 or of the side faces 92 relative to the eyelashes or the eyebrows.

In the embodiment in FIGS. 3 and 4, the core 10 presents as cross-section that is hexagonal, but the invention is not limited to a core with a section of any particular shape.

The length of the teeth 18 may decrease towards the distal end 12 of the core 10, as can be seen in FIG. 3, so as to facilitate engagement in the container 3. The length of the teeth 18 may also decrease towards the stem 7, as shown in FIG. 3, so as to make it easier for the applicator member 8 to pass through the wiper member 6 while the applicator 2 is being removed from the container.

The teeth 18 may present various shapes. For example, as shown, each tooth 18 may include a first longitudinal face 40 of plane shape and a second longitudinal face 41 of rounded shape, in particular of half-cone shape, the invention not being limited to teeth of a particular shape.

As shown in FIG. 5, each face 15 of the core carries a first row of teeth 17*a* that are connected to the corresponding face 15 of the core 10 while forming an angle $\alpha_{Z1}$ relative to the normal thereto, and a second row of teeth 17*b* that are connected to the face 15 obliquely, forming an angle $\alpha_{Z2}$ relative to said normal. The teeth 18 of the first row 17*a* extend along a direction $Z_1$ that is substantially perpendicular to the face 15, the angle $\alpha_{Z1}$ being relatively small, e.g. less than 10°, or even less than 5°. The teeth 18 of the row 17*b* are also straight in the embodiment under consideration, extending along a direction $Z_2$, forming an angle $\alpha$ with the direction $Z_1$. By way of example, the angle $\alpha$ lies in the range 20° to 80°. The teeth 18 of each row 17*a* and 17*b* may be separated by a separation surface S, the surface S being a plane bisecting the angle $\alpha$, for example. In other words, the rows 17*a* and 17*b* may constitute a double row 17 comprising teeth that are disposed alternately on opposite sides of a separation surface S, a tooth of a row 17*b* following a tooth of a row 17*a* along the longitudinal axis of the row, as shown in FIG. 5*a*.

In a variant, the rows may be single, as shown in FIG. 5*b*, the teeth 18 of common row 17 being in alignment.

In the embodiment shown in FIGS. 1 to 5, the shape of the cross-section of the envelope surface E is oblong.

Naturally, it would not be beyond the ambit of the present invention for the shape to be different, e.g. oval, as shown in FIG. 6*a*, rectangular, as shown in FIG. 6*b*, lozenge-shaped, as shown in FIG. 6*c*, trapezoidal, as shown in FIG. 6*d*, lens-shaped, as shown in FIG. 6*e*, kidney-shaped, as shown in FIG. 6*f*, or even with two plane main faces 90 and two triangular side faces 92, as shown in FIG. 6*g*.

In a variant, the main faces 90 may be outwardly concave, as shown in FIG. 6*h*. In a variant, the side faces 92 may be outwardly convex, as shown in FIG. 6*i*. The same applies for the main faces 90 that may be outwardly convex, for example.

The flat shape of the envelope surface E may be obtained by means of the length of the teeth, the core presenting a shape that is not flat. By way of example, FIG. 7 shows a core of cross-section that is circular, including long teeth 18*b* and short teeth 18*c* defining an envelope surface E of cross-section of shape that is flat.

In the embodiment shown in FIG. 7, the teeth are distributed in double rows of teeth that are distributed regularly around the longitudinal axis X of the core.

Furthermore, the long teeth 18*b* are the same length on either side of the core, but it would not be beyond the ambit of the present invention for this to be otherwise, and for the long teeth 18*b* to be of different lengths depending on the side of the core to which they are connected.

The cross-section of the core may be of shape that is different, e.g. being oblong, as shown in FIGS. 7*a*, 8, and 9.

The cross-section of the core may be flat of major axis of the same orientation as the major axis of the cross-section of the envelope surface, as shown in FIG. 7*a*, the teeth being of length that is less than the greatest transverse dimension of the core.

In the embodiment in FIG. 8, the long teeth are situated on the narrow sides of the core, and the short teeth 18*c* on the wide sides of the core. In this configuration, the flat shape of the envelope surface is obtained both by means of the flat shape itself of the cross-section of the core, and by the disposition of the long and short teeth on the core.

Naturally, other configurations could be envisaged. By way of example, FIG. 9 shows an embodiment in which the cross-section of the envelope surface is flat in a direction that is perpendicular to the flat direction of the cross-section of the core. In order to obtain the flat shape of the envelope surface, long teeth 18*b* are disposed on the wide faces of the core, while short teeth 18*c* are disposed on the narrow faces of the core.

In this embodiment, the long teeth 18*b* disposed on one side of the core are longer than the long teeth 18*b* disposed on the other side of the core. Naturally, this could be otherwise, and the long teeth 18*b* disposed on either side of the core could be of the same length.

In addition, the teeth may be radial, with their long axes passing through the longitudinal axis of the core, or they may be non-radial, as shown in FIG. 9.

Furthermore, in all of the embodiments described above, the long teeth 18*b* and the short teeth 18*c* could be separated by teeth of intermediate length lying between the longest length of the long teeth and the smallest length of the small teeth.

Naturally, the cross-section of the core may be of some other shape, as shown in FIGS. 10*a* to 10*m*.

Figure 10A:
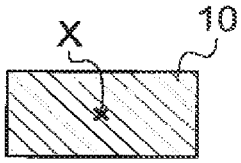
Figure 10B:
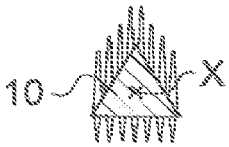
Figure 10C:
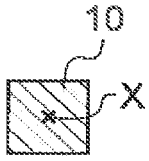
Figure 10D:
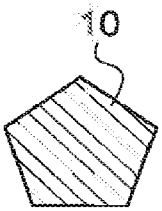
Figure 10E:
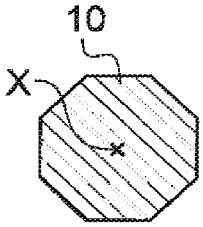

The core 10 may have a cross-section that is: polygonal, e.g. rectangular, as shown in FIG. 10*a*; triangular, as shown in FIG. 10*b*; square, as shown in FIG. 10*c*; pentagonal, as shown in FIG. 10*d*; heptagonal; or octagonal, as shown in FIG. 10*e*.

Figure 10F:
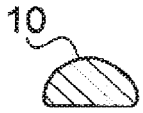
Figure 10G:
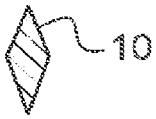
Figure 10H:
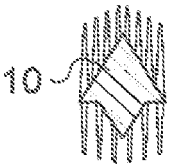
Figure 10I:
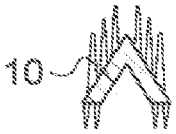
Figure 10J:
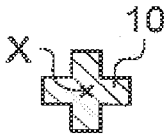
Figure 10K:
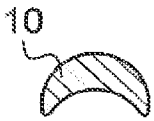
Figure 10L:
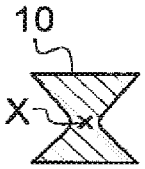
Figure 10M:
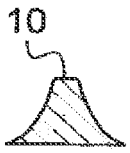

The core may have a cross-section that is: semi-circular, as shown in FIG. 10*f*; lozenge-shaped, as shown in FIG. 10*g*; formed of two adjacent triangles of different sizes, as shown in FIG. 10*h*; triangular with a groove, as shown in FIG. 10*i*; cross-shaped, as shown in FIG. 10*j*; crescent-shaped, as shown in FIG. 10*k*; hourglass shaped, as shown in FIG. 1*l*; or semi-hourglass shaped, as shown in FIG. 10*m*.

In the embodiments shown in FIGS. 10*b*, 10*h*, and 10*i*, the teeth are all parallel to one another. Naturally, it would not be beyond the ambit of the present invention if the teeth were to be arranged in some other way.

Whatever the site of the teeth in a row, two successive rows around the longitudinal axis X of the core may be identical, as shown in FIG. 10*n*. However, the teeth of a single row may vary in their shapes, their thicknesses, or their materials, for example. This variation is shown diagrammatically by firstly teeth in the shape of circles, and secondly teeth in the shape of triangles.

Whatever the way in which the teeth are implanted, at least one tooth may have a cross-section that is semi-circular, as shown in the embodiment in FIGS. 1 to 5. In a variant, the section may be: circular; or triangular; or even lozenge-shaped; formed of two adjacent triangles of different sizes; hourglass shaped; or semi-hourglass shaped; or triangular with a groove; cross-shaped; square-shaped; semi-circular shaped with a groove. The teeth are preferably of cross-section other than circular. A non-circular shape for the cross-section of the teeth may favor the retention of composition on the teeth or between consecutive teeth.

The teeth of the rows forming a double row may be parallel to one another. In a variant, the long directions of the teeth may diverge when the core is observed along its longitudinal axis, the teeth forming V shapes.

In section, in a longitudinal-section plane containing the core, the teeth may slope relative to the core, crossing one another above the core, as shown by way of example in FIG. 11.

The teeth may co-operate with the longitudinal axis of the core to form an angle that increases and then decreases along the longitudinal axis X of the core, so that they are disposed in a fan configuration when the applicator member is observed in a direction that is perpendicular to the longitudinal axis of the core, as shown in FIG. 12.

The teeth arranged on either side of the core may be of lengths that are different, as shown in FIG. 12*a*, so that the core is off-center relative to the envelope surface E.

The teeth 18 may include narrowing at their bases, imparting flexibility thereto during application, and enabling supplies of composition to be formed.

The teeth 18 may be of long axis that is non-rectilinear.

In a variant embodiment, the longitudinal faces 15 of the core 10 are twisted, as shown in FIG. 13. In order to make such a shape, the core 10 may be deformed during molding by turning the endpiece 9, or, in a variant, it may be deformed in the mold.

The longitudinal axis X of the core 10 may coincide with the longitudinal axis V of the stem 7, but it would not be beyond the ambit of the present invention for this to be otherwise. By way of example, FIG. 14 shows a variant embodiment in Which the longitudinal axis X of the core 10 forms an angle β1 with the longitudinal axis Y of the stem. By way of example, such a configuration may improve the ergonomics of the applicator.

Figure 15A:
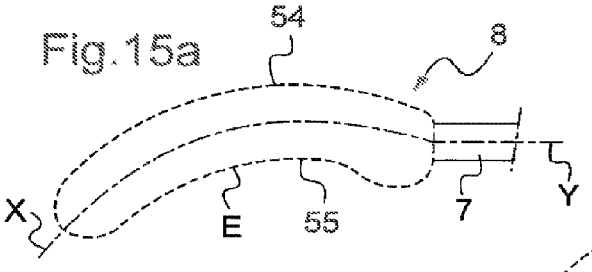

The applicator may extend along a longitudinal axis X that is not rectilinear. FIG. 15*a* shows a variant embodiment in Which the core extends along a longitudinal axis X that is curved. When observed in longitudinal section, as in FIG. 15*a*, the envelope surface E may, on one side of the axis X, present a convex first profile 54 substantially in the same direction as the axis X, and, on the opposite side of the axis X, a concave second profile 55 in the same direction as the axis X.

The distal end of the envelope surface E of the applicator may be off-center relative to the longitudinal axis Y of the applicator, as shown in FIG. 15*a*, or, on the contrary, it may be on said axis.

The envelope surface may be cylindrical with a section that is not circularly symmetrical, or of non-cylindrical shape passing through one maximum or through two maxim urns.

Figure 15B:
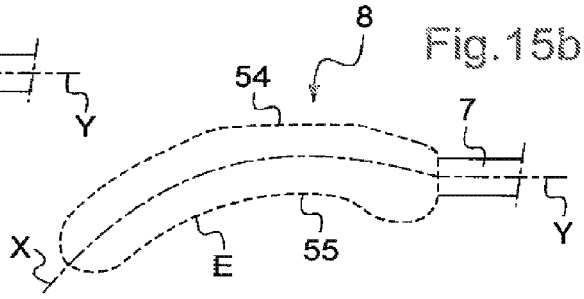

In the variant shown in FIG. 15*b*, the envelope surface E presents two opposite longitudinal profiles 54 and 55, of which the profile 54 is straight. FIG. 15*i* is a side view showing the FIG. 15*b* applicator.

Figure 15C:
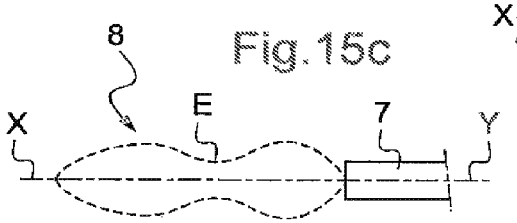
Figure 15D:
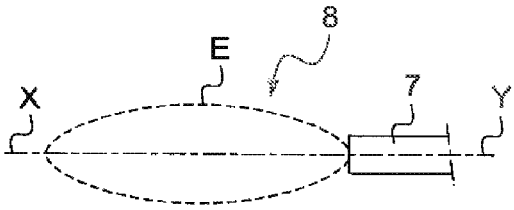

In a variant, the envelope surface E may present a cross-section that passes through two maximums and one local minimum, as shown in FIG. 15*c*, or through one maximum as shown in FIG. 15*d*. FIG. 15*j* is a side view showing the FIG. 15*d* applicator.

In longitudinal section, observed in a plane that is perpendicular to the direction F, the envelope surface may thus be ball shaped; peanut shaped; bullet shaped; or conical, semi-conical, or frustoconical; it may include one or two bevels at each end or it may be fish shaped.

Figure 15E:
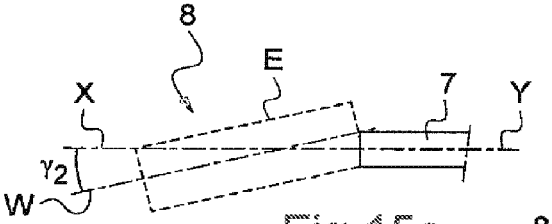

In another variant, shown in FIG. 15*e*, the envelope surface E extends generally along a longitudinal axis W that forms an angle $\gamma_2$ with the longitudinal axis X of the core 10.

Figure 15F:
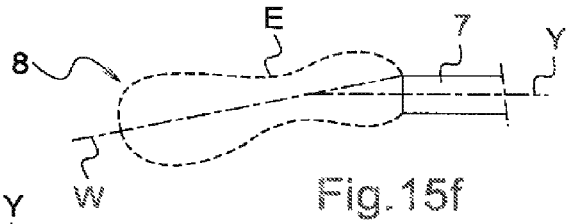

The FIG. 15*f* variant differs from the FIG. 15*e* variant in the shape of the envelope surface E that presents a cross-section that passes through a minimum.

Figure 15G:
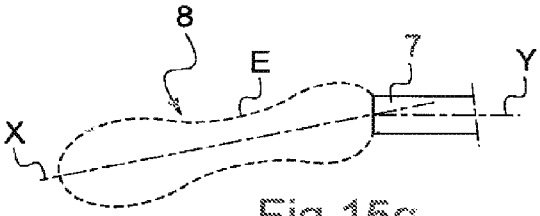

The longitudinal axis X of the core 10 may be rectilinear and may form an angle with the longitudinal axis Y of the stem 7, as shown in FIG. 15*g*, the envelope surface E having, for example, a cross-section that is not constant, e.g. passing through a minimum.

Figure 15H:
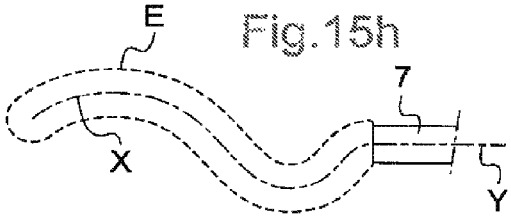
Figure 15I:
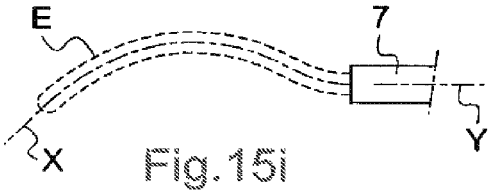
Figure 15J:
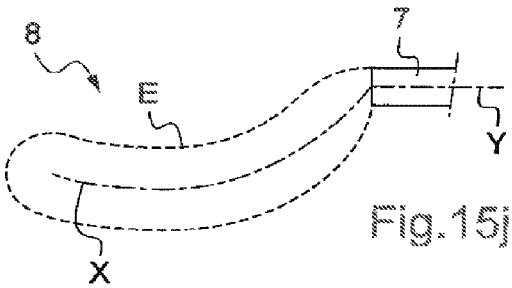

In a variant, the longitudinal axis X of the core 10 may be curved, presenting a point of inflection and two opposite curvatures, as shown in FIG. 15*h*.

In the variant embodiments shown in FIGS. 16 and 17, the core 10 includes a recess in which there is engaged a support 60, e.g. made of metal or plastics material. The core 10 may be configured to be fastened to the support 60, or it may be free to turn or to move in translation relative to the support 60. By way of example, the core 10 may also be molded on the support 60. In FIG. 16, the core surrounds the support 60, while in FIG. 17, the support 60 extends beyond the core and presents a wide head 61.

The teeth of at least one row may present different lengths, passing through an extremum between the extreme teeth of the row, for example.

At least one of the teeth 18 of the rows 17 may present a surface state that is not smooth, e.g., having ridges as a result of molding or roughness linked to the presence of a filler in the plastics material, for example.

The applicator member may be made with a plastics material that includes magnetic particles. The magnetic field created by such particles, that may be magnetizable and/or magnetized, may interact with magnetic fibers or pigments that are present in the composition.

The applicator member may be made with flocking, said flocking extending over the teeth only or over the core only, for example.

At their free ends, the teeth may present portions in relief or of a particular shape, e.g. a fork, a hook, or a head, as shown in FIGS. 18*a*, 18*b*, and 18*c* respectively. By way of example, the hook may extend transversally, parallel, or obliquely relative to the longitudinal axis X of the core. In order to obtain the beads, it is possible to heat the applicator member in such a manner as to melt the ends of the teeth, for example. In order to obtain the forks or the hooks, it is possible to treat the applicator member mechanically, e.g., by grinding, and thus to abrade the ends of the teeth.

The wiper member may be made out of elastomer.

The wiper member may include a wiper orifice 6*a* of shape that is circular, as shown in FIG. 19*a*, and it may have slots 6*b*, as shown in FIGS. 19*b* and 19*c*. In FIG. 19*b* the slots are radial, and in FIG. 19*c* the slots are tangential to the wiper orifice.

By way of example, the diameter d of the wiper orifice 6*a* of the wiper member 6 may lie in the range 3 mm to 5.5 mm, e.g. about 4.5 mm or 5 mm. Examples of values are given in table 1 above, for various values l and e.

The wiper member 6 may possibly include undulations 6*c*, as shown in FIGS. 19*d* and 19*e*, enabling the wiper orifice to widen more easily when the applicator member passes therethrough. FIG. 19*d* is a view of the wiper orifice as seen looking along arrow VI in FIG. 19*e*.

The wiper orifice may thus be defined by an undulating wiper lip 9, having an inside free edge that defines the wiper orifice 6*a*, as shown in FIG. 19*e*. The wiper member 6 may include a number of undulations 6*c* lying in the range 3 to 12, for example. The wiper lip 9 may extend generally along a cone that converges towards the bottom of the container, having a generator line G that forms an angle i with the longitudinal axis of the container. While the applicator member is passing through the wiper orifice, the diameter of the wiper orifice increases from 4 mm to 5.5 mm, for example, without excessively deforming the wiper member, by deploying the undulations.

In a variant, the wiper lip 9 may extend generally along a mid-plane that is perpendicular to the axis X, or it may even extend generally along a cone that converges towards the outlet of the container.

Still in a variant, the wiper orifice may be oblong, as shown in FIG. 19*f*.

The wiper member may be made in some other way, e.g. it may comprise a block of foam that may be slotted.

The wiper member may also be adjustable, where appropriate.

The wiper member may be as described in patent applications or US patents Nos. 2005/0028834, 2005/0175394, 2004/0258453, U.S. Pat. Nos. 6,375,374, 6,328,495, 7,455,468, for example.

The wiper member may optionally be flocked.

At least some and in particular all of the stem 7 to which the applicator member is fastened may be flexible, in particular in the proximity of the applicator member.

By way of example, the stem 7 may include at least one flexible element 80, as shown in FIG. 20*a*, e.g. made of elastomer. The flexible element may present a shape that imparts flexibility, e.g. at least one annular groove 81, as shown in FIG. 20*b*. By way of example, the flexible element is as described in EP 1 917 883 A2 and may be made, at least in part, out of a material from the following list: elastomer material; thermoplastic; thermoplastic elastomer; low-density polyethylene (LDPE); PVC; PU; thermoplastic elastomer polyesters, in particular copolymers of esterified polytetramethylene oxide glycol and butene terephthalate; Hytrel®; EPDM; propylene-diene terpolymer (POM); EVA; SIS; SEBS; styrene-butadiene-styrene (SBS); latex; silicone rubber; nitrile rubber; butyl rubber; polyurethane; polyether block amide; polyester; this list not being limiting. The flexible element 80 may be made of a material having hardness that lies in the range 25 on the Shore A scale (ShA) to 80 on the Shore D scale (ShD), for example, or even in the range 40 ShA to 70 ShD. The rigid portions of the stem may be made of a thermoplastic material, in particular one of the materials selected from the following list: high-density polyethylene (HDPE); LUPE; linear PE; polycrystalline (PT); PP; POM; PA; PET; and polybutyl terephthalate (PBT); this list not being exhaustive.

The flexibility in fastening the applicator member to the stem 7 may also be provided by clearance formed between the end of the stem 7 and the core 10 of the applicator member 8, around the fastener endpiece 9 for fastening the applicator member 8 in the stem 7, e.g. as a result of the endpiece 9 not being driven completely into the corresponding housing of the stem 7, The applicator member may be made by any known method such as injection-molding, dual-injection-molding, and protrusion, in which material is injected through at least one portion of the core, so as to enable teeth to be formed. Such teeth obtained by protrusion are shown in FIG. 21.

In order to use the device 1, the user unscrews the closure cap 5 and removes the applicator member 8 from the container 3.

After the applicator member 8 has passed through the wiper member 6, a certain quantity of composition remains between the rows 17 and between the teeth 18 of the rows.

The user may select one of the main faces 90 or one of the side faces 92 for applying the composition to the eyelashes or the eyebrows. While applying makeup, the user may also modify the orientation of the applicator member relative to the eyelashes or the eyebrows, in such a manner as to use another of the faces so as to modify the wiping movement used to apply the makeup.

In a variant, the user may use one or the other of the faces during two different wiping movements used to apply the makeup, thereby making; it possible to produce two different makeup effects with a single applicator.

Naturally, the invention is not limited to the above-described embodiments, the characteristics of which may be combined together within variants not shown.

The applicator member may be a vibrator member, i.e. vibration may be applied to the applicator during application, combing, or while taking the composition, e.g. as described in application WO 2006/090343.

Still in a variant, the applicator member may be rotary, i.e. it may be turned about the longitudinal axis of the core, e.g. during application, combing, or while taking the composition.

Still in a variant, the applicator member may deliver heat, i.e. it may include a heater element making it possible to heat the eyelashes or the eyebrows, the teeth, and/or the core of the applicator member.

It is also possible that the applicator member may vibrate, turn, and heat, or merely vibrate and turn, or merely vibrate and heat, or merely turn and heat, or merely vibrate, or merely turn, or merely heat.

The applicator member may include any bactericidal agent such as silver salts, copper salts; preservatives; and at least one agent for preserving the composition such as parabens or other preservatives.

The core and/or the teeth may further include particles, e.g. a filler, in particular a magnetic, bacteriostatic, or humidity-absorbing compound, or even a compound for creating roughness at the surface of the tooth, or for encouraging sliding of the eyelashes over the teeth. At least one of the core and a tooth may be flocked, may receive any heat treatment or mechanical treatment, and/or may include particles, e.g. a filler, in particular for improving sliding.

The expression "comprising a" should be understood as being synonymous with "comprising at least one", and "lying in the range" should be construed as including the limits of the range, unless specified to the contrary.

The invention claimed is:

1. An applicator for applying a cosmetic composition to the eyelashes or the eyebrows, the applicator including a molded applicator member comprising:

a core that extends along a longitudinal axis; and teeth that extend from the core, the teeth being disposed in more than four longitudinal rows along the longitudinal axis (X) of the core;

the teeth presenting free ends that define an envelope surface (E) of the applicator member, the envelope surface presenting, at least at one point along a length of said envelope surface, a cross-section of shape that is flat, having a greatest transverse dimension (l) lying in the range 7 mm to 12 mm, and a thickness (e) lying in the range 3.5 mm to 7 mm, the rows of the teeth differing only by the lengths of the teeth from one row to another for a common axial position along the longitudinal axis of the core.

2. An applicator according to claim 1, the teeth of all of the rows contained in a cross-section being of the same thickness ($d_1$), and/or two successive teeth of two rows taken in a common segment of the envelope surface (E) having spacing ($d_2$) between them that is identical.

3. An applicator according to claim 1, wherein the ratio l/e of the greatest transverse dimension (l) to the thickness (e) of a common cross-section of the envelope surface lies in the range 1.3 to 4.5.

4. An applicator according to claim 1, wherein the core presents, in cross-section, a greatest transverse dimension (l) lying in the range 1.5 mm to 6 mm.

5. An applicator according to claim 1, wherein the core presents at least one cross-section of regular polygonal or circular shape.

6. An applicator according to claim 1, wherein two teeth of two different rows forming part of a common cross-section of the applicator member have the same shape.

7. An applicator according to claim 1, wherein two teeth of two different rows forming part of a common cross-section of the applicator member have the same cross-section.

8. An applicator according to claim 1, wherein two teeth of two different rows forming part of a common cross-section of the applicator member are molded out of the same material.

9. An applicator according to claim 1, including at least five rows of teeth, better at least six rows.

10. An applicator according to claim 1, including, in a given cross-section, long teeth and short teeth.

11. An applicator according to claim 1, wherein the teeth are distributed all around the core in regular manner in at least a common cross-section, or even over a major fraction of the length of the core.

12. A packaging and applicator device comprising:

a container containing a composition for application to the eyelashes and/or the eyebrows; and an applicator according to claim 1.

13. A device according to claim 12, including a wiper member for wiping the applicator member, the wiper member including a wiper orifice presenting a greatest transverse dimension lying in the range 2.5 mm to 6.5 mm.

14. A device according to claim 13, wherein the wiper member includes a wiper orifice that presents a greatest transverse dimension that is less than a greatest transverse dimension (l) of the applicator member.

15. A device according to claim 14, the applicator member being set back by a distance that is less than 1.5 mm from the inside surface of the container when the applicator is in place on the container in a storage position.

* * * * *